US005582532A

United States Patent [19]

Tucker

[11] Patent Number: 5,582,532

[45] Date of Patent: Dec. 10, 1996

[54] GLITTER TOY

[76] Inventor: Sheridan G. Tucker, 12308 Nieman Rd., Overland Park, Kans. 66213

[21] Appl. No.: 514,239

[22] Filed: Aug. 11, 1995

Related U.S. Application Data

[63] Continuation-in-part of Ser. No. 352,388, Dec. 8, 1994, abandoned.

[51] Int. Cl.[6] ..... A63H 33/30

[52] U.S. Cl. ..... 446/475; 446/236; 239/226

[58] Field of Search ..... 446/236, 259, 446/475; 239/568, 240, 225.1, 226, 263.1, 214, 222, 237, 239; 273/144 A, 144 B, 144 R

[56] References Cited

U.S. PATENT DOCUMENTS

| | | | |
|---|---|---|---|
| 729,425 | 5/1903 | Schuler | 239/568 |
| 825,843 | 7/1906 | Kliemandt . | |
| 1,241,450 | 9/1917 | Taylor . | |
| 1,491,809 | 4/1924 | Macchia . | |
| 1,661,048 | 2/1928 | Nose . | |
| 2,282,622 | 5/1942 | Torrence . | |
| 2,345,173 | 3/1944 | Baggott . | |
| 2,648,568 | 8/1953 | Sommer . | |
| 2,730,404 | 1/1956 | Meisinger | 239/568 |
| 2,912,170 | 11/1959 | English et al. . | |
| 2,917,241 | 12/1959 | Waldrum | 239/222 |
| 3,073,262 | 1/1963 | Bowe . | |
| 3,140,875 | 7/1964 | Abbott et al. . | |
| 3,200,737 | 8/1965 | Ferenc . | |
| 3,224,142 | 12/1965 | Pawelka et al. . | |
| 3,583,641 | 6/1971 | Sterz | 239/568 |
| 3,731,421 | 5/1973 | Frattolillo et al. . | |
| 4,090,310 | 5/1978 | Koff . | |
| 4,379,523 | 4/1983 | Schanz et al. . | |
| 5,209,692 | 5/1993 | Coleman et al. . | |
| 5,338,242 | 8/1994 | Cheng . | |
| 5,351,890 | 10/1994 | Clements . | |

FOREIGN PATENT DOCUMENTS

| | | | |
|---|---|---|---|
| 281122 | 8/1990 | German Dem. Rep. | 446/259 |
| 1478731 | 5/1969 | Germany | 446/475 |
| 667301 | 9/1964 | Italy | 273/144 R |

*Primary Examiner*—Robert A. Hafer
*Assistant Examiner*—Jeffrey D. Carlson
*Attorney, Agent, or Firm*—Chase & Yakimo

[57] ABSTRACT

A toy for dispersing reflective particles includes a hand-held support, a rotatable shaft extending from the support, and a hollow enclosure on the shaft rotatable therewith and housing the reflective particles. The enclosure has a plurality of spaced apertures therein through which the particles are caused to pass under centrifugal force upon rotation of the shaft. This causes a burst of the reflective particles to be dispersed into the surrounding air. The enclosure may angularly extend from shaft to aid in the dispersion of the particles. The toy is electrically operated by a motor and batteries housed within the support. The toy may also include a filler opening through which the particles are loaded into the enclosure and a closure which fits within the opening to prevent the particles from escaping through the opening after they are loaded. Alternatively, the toy includes flaps which cover each aperture and allow particles to be loaded into an open end of enclosure but which open or uncover each aperture upon rotation of enclosure to allow the particles to disperse into the air.

11 Claims, 2 Drawing Sheets

GLITTER TOY

CROSS REFERENCE

This application is a continuation-in-part of application Ser. No. 08/352,388 filed Dec. 8, 1994; now abandoned.

FIELD OF THE INVENTION

This invention relates to a toy for use on special social occasions, such as birthdays, weddings or New Year's Eve, and for amusement. More particularly, the invention relates to a hand-held device which dispenses reflective particles, such as glitter or confetti stored therein into the surrounding air.

BACKGROUND OF THE INVENTION

Reflective particles, such as glitter or confetti, are often scattered into the air, and over floors, tables and people, for amusement and on social occasions such as birthdays, weddings and New Year's Eve. Various types of devices have been proposed to scatter the reflective particles. These include simple cannons, horns, guns, pumps and a squeezable envelope device having confetti positioned within an inverted pocket within the envelope. These types of devices are disclosed in U.S. Pat. Nos. 825,843 to Kliemandt; 1,491,809 to Macchia; 2,345,173 to Baggott; 3,731,421 to Frattolillo et al; 5,338,242 to Cheng; and 5,351,890 to Clements. However, a desirable propelling device should be totally safe to operate, easy to reload and simple in construction, and should create a special effect not readily obtainable by releasing the particles by hand.

SUMMARY OF THE INVENTION

It is, therefore, a primary object of the invention to provide a hand-held device including a reflective particle housing or enclosure having apertures therein through which the particles are caused to pass upon rotation of the housing so that a burst of the particles is dispersed into the surrounding air to create a unique effect.

Another object of the present invention is to provide such a device having flaps over the apertures which remain closed to hold the reflective particles within the housing and open upon rotation of the housing to allow the particles to disperse.

Another object of the present invention is to provide such a device that is lightweight and inexpensive to manufacture.

Yet another object of the present invention is to provide a reflective particle dispersing device that is reusable and into which the particles may be readily loaded.

Still a further object of the present invention is to provide a device that disperses reflective particles continuously and uniformly, thus producing a prolonged burst of the particles and an attractive reflective effect.

The foregoing objects are basically attained by providing a toy for dispersing reflective particles, such as glitter or confetti, having a support which presents a handle for hand-held use of the toy by a user, a rotatable shaft extending from the support and a hollow enclosure on the shaft rotatable therewith for receiving the reflective particles. The enclosure includes an imperforate portion into which the reflective particles are loaded and a perforate portion having a plurality of spaced apertures therein. The enclosure may also include a filler opening therein through which the reflective particles are loaded into the enclosure. A closure is insertable within the filler opening to prevent the reflective particles from escaping therethrough. A power means is housed within the support and operatively connected to the shaft for rotating the shaft and the enclosure so that the reflective particles are caused to pass through the apertures under centrifugal force upon rotation of the shaft, whereby a burst of the reflective particles is dispersed into the surrounding air.

Additionally, the enclosure may be releasably attached to the shaft at one end so that it may be screwed onto and off of the shaft and the particles 10 loaded into the enclosure at the one end. Flexible flaps extending over each opening hold the reflective particles within the housing. Upon rotation of the housing, the flaps open to allow dispersion of the particles. The enclosure also may angularly extend from the shaft which, upon rotation of the enclosure, helps force the particles into the perforate portion of the enclosure and out through the apertures.

DETAILED DESCRIPTION

Figure 1:
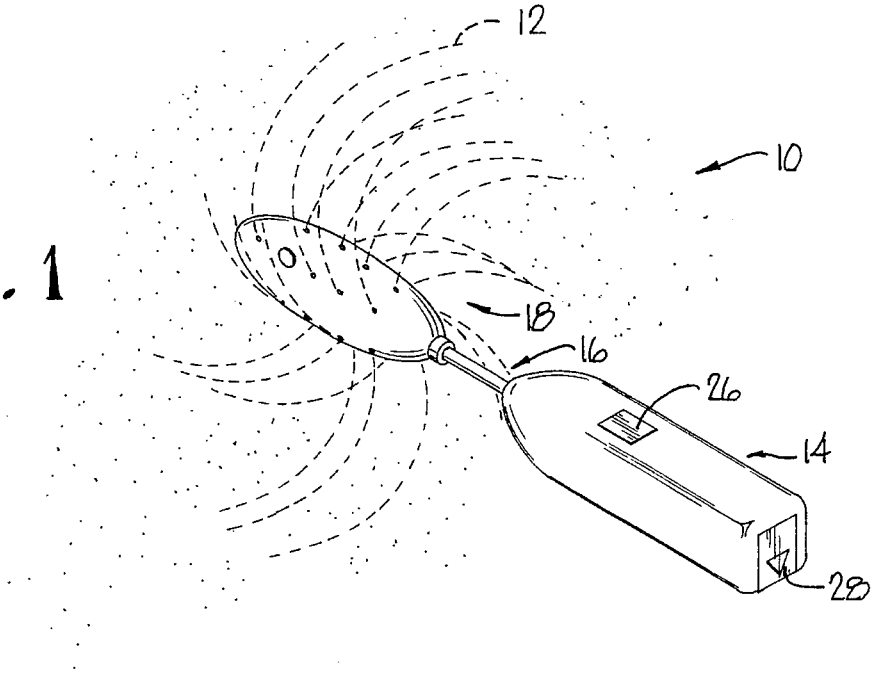
FIG. 1 is a perspective view of the toy in accordance with the present invention showing a burst of glitter being dispersed into the surrounding air.

As seen in FIG. 1, a toy 10 for dispersing glitter 12 in accordance with the present invention is shown and includes an elongated support 14, a rotatable shaft 16 extending longitudinally from the support 14 and a hollow enclosure 18 on the shaft 16 which receives the glitter 12. The enclosure 18 rotates with the shaft 16 and causes a burst of the glitter 12 under centrifugal force to be dispersed into the surrounding air.

Toy 10 is preferably for use on special social occasions, such as birthdays, weddings, anniversaries and New Year's Eve. Reflective particles, such as confetti or glitter, are often scattered into the air on these occasions. The dispersing action of toy 10 is different from other devices that have been proposed to scatter these types of particles because it creates a continuous burst of the particles into the surrounding air resulting in a firework-like effect. Furthermore, toy 10 can be quickly reloaded with new glitter or confetti and used over and over again.

Although glitter 12 is shown with toy 10 in FIG. 1, glitter 12 can be any other type of reflective particle, such as confetti. Any color of glitter or confetti can be used to correspond to the particular occasion. For instance, gold glitter would be particularly appropriate for a 50th anniversary celebration, and confetti would be more appropriate at weddings.

Figure 2:
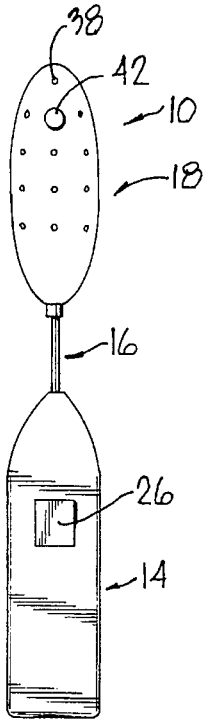
FIG. 2 is a front view of the toy of FIG. 1.
Figure 3:
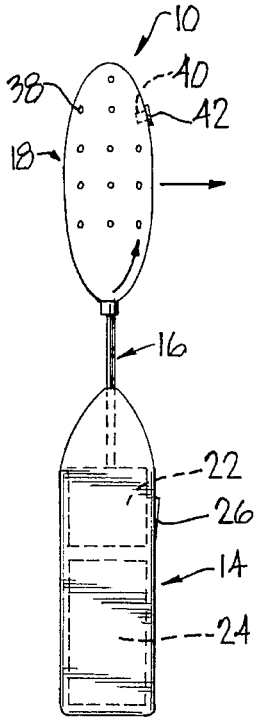
FIG. 3 is a side view of the toy of FIG. 1 showing the location of the motor and batteries within the hand-held support.

Support 14 comprises a generally rectangular case and presents a handle for hand-held use of the toy 10 by a user. Support 14 is preferably composed of rigid plastic and is substantially hollow for housing a motor 22, as seen in FIG. 3. Motor 22 is electrically operated by batteries 24 via switch 26 which extends outwardly from one side of support 14 and is operated by the user of toy 10. Motor 22 can be of the type used in small battery powered kitchen utensils, such as a beater and preferably operates off of two AA batteries 24. Batteries 24 are inserted and removed through one end of support 14 and retained by a cover plate 28. Shaft 16 is rotatably connected at its inner end to motor 22 and extends from motor 22 through the opposite end of support 14 in axial alignment therewith, as seen in FIG. 3.

Figure 4:
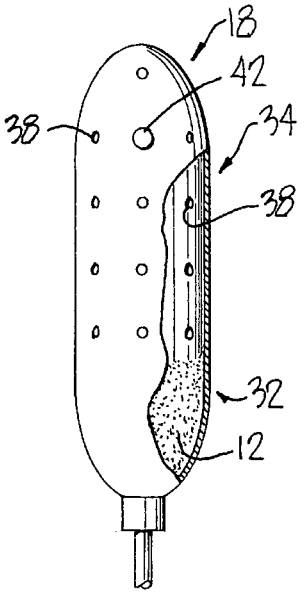
FIG. 4 is an enlarged front view of the enclosure of the glitter toy of FIG. 1 partially broken away to show the glitter loaded therein.

Enclosure 18 has an elongated, generally oval configuration, is axially aligned with the shaft 16 and is affixed to the outer end of shaft 16 spaced from support 14. Enclosure 18 is preferably composed of rigid plastic and includes an imperforate portion 32 proximal to shaft 16 and an outer, perforate portion 34. Glitter 12 is loaded into enclosure 18 and rests within imperforate portion 32, as seen in FIG. 4. Imperforate portion 32 tapers outwardly from shaft 16 and merges with perforate portion 34.

The perforate portion 34 includes a plurality of spaced apertures 38 and may have a filler opening 40 therein. Apertures 38 have a relatively small diameter in comparison to the diameter of filler opening 40. The diameter of apertures 38 is relatively small when glitter 12 is used with toy 10. Alternatively, toy 10 can be configured with apertures 38 having a larger diameter for use with confetti. Regardless of the type of particle used with toy 10, the diameter of apertures 38 is slightly larger than the diameter of the particles. Filler opening 40 preferably has a relatively large diameter in comparison to the diameter of apertures 38 to facilitate loading glitter 12 or other particles into enclosure 18 therethrough.

A closure 42, preferably composed of rubber, fits snugly within filler opening 40 to plug it and prevent the unwanted escape of glitter 12 when toy 10 is being stored or operated. Closure 42 is easily insertable and removable from within filler opening 40 because it includes a circular lip which has a larger diameter than filler opening 40. The lip thereby prevents over insertion of closure 42 and aids in the easy removal of closure 42 from within filler opening 40.

In operation, toy 10 is hand-held by the user. Glitter 12 is loaded into the enclosure 18 through filler opening 40. Once loaded, the glitter 12 rests in the lower imperforate portion 32, as seen in FIG. 4. Closure 42 is inserted into opening 40 so that glitter 12 cannot escape therethrough. The user activates toy 10 by depressing the switch 26 which electrically connects the motor 22 with the batteries 24. The energized motor 22 drives shaft 16 which, in turn, rotates enclosure 18 about its longitudinal axis. The outward taper of imperforate portion 32 of enclosure 18 and centrifugal force created by the rotation of the enclosure 18 cause the glitter 12 to move upward into perforate portion 34, continuously flow through apertures 38 and burst into the surrounding air, as shown by the arrows in FIG. 3. Toy 10 is deactivated when the user releases the switch 26, which would typically occur when most or all of the glitter 12 is emptied from within the enclosure 18. Closure 42 may then be removed from within the filler opening 40 and more glitter 12 can be loaded into the enclosure 18. Toy 10 is then ready for immediate reuse.

Second Embodiment

Figure 5:
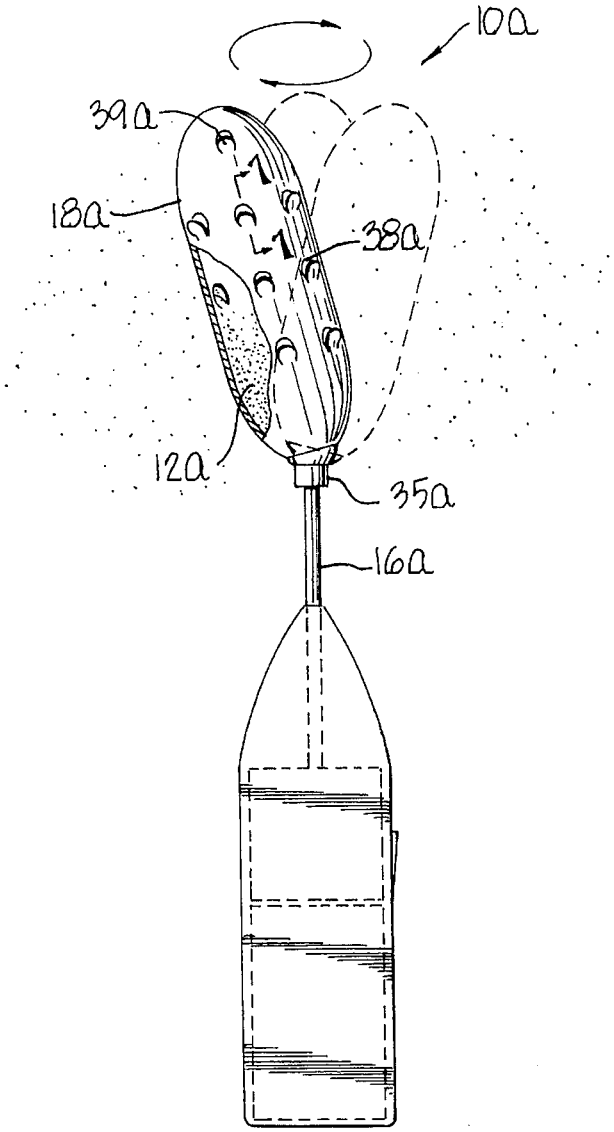
FIG. 5 is a perspective view of a second embodiment of the toy in accordance with the present invention showing the rotation of the angularly extending enclosure in phantom lines.
Figure 7:
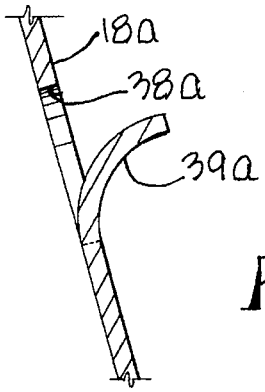
FIG. 7 is a cross-sectional view taken along line 7—7 of the toy of FIG. 5 showing a flap in its opened position during rotation of the enclosure.
Figure 6:
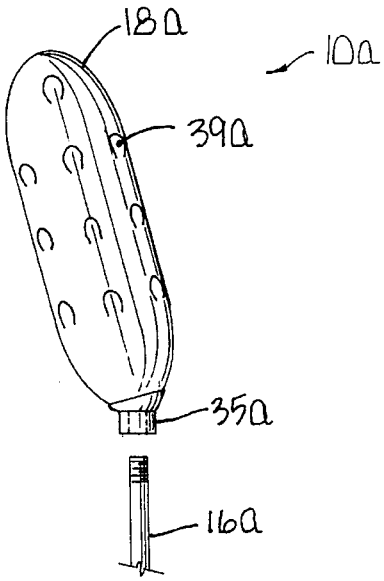
FIG. 6 is an enlarged front view of the toy of FIG. 5 showing the enclosure released from the shaft for loading glitter therein.

A second embodiment, toy **10*a*, is shown in FIGS. 5–7**. Only the differences between the first and second embodiments are discussed.

Enclosure **18*a* extends angularly from the outer end of shaft 16*a* and is preferably off-set from the shaft's axis 12°–15°. The angle of enclosure 18*a* aids in the dispersion of glitter 12*a* loaded therein from the imperforate portion 32*a* of enclosure 18*a* into the perforate portion 34*a* and out through apertures 38*a* when enclosure 18*a* is rotating due to the centrifugal force created thereby, as seen in FIG. 5**.

Enclosure **18*a* is also releasably secured to the outer end of shaft 16*a*. The proximal end of enclosure 18*a* is open and terminates in an internally threaded collar 35*a* which receives the threaded outer end of shaft 16*a* therein. Thus, glitter 12*a* is loaded into enclosure 18*a* via this open proximal end through collar 35*a* before attaching enclosure 18*a* to shaft 16*a***.

Glitter **12*a* does not escape through apertures 38*a* upon being loaded into enclosure 18*a* due to flexible flaps 39*a* of enclosure 18*a*. One flap 39*a* extends over and covers or plugs each aperture 38*a*, as shown in FIG. 6. Flaps 39*a* may be made of any flexibly resilient material but are preferably formed of polyvinylchloride, and are united with the plastic enclosure 18*a* as best seen in FIG. 7. The secure end of each flap 39*a* is proximal to shaft 16*a* and extends over a corresponding aperture 38*a* or upwardly as viewed in FIG. 6. When enclosure 18*a* rotates, the centrifugal force created thereby causes flaps 39*a* to open, as shown in FIGS. 5 and 7. This, in turn, allows glitter 12*a* to be dispersed from apertures 38*a* into the surrounding air. Flaps 39*a* close over the corresponding apertures 38*a* when toy 10*a*** is deactivated.

Having thus described the invention, what is claimed as new and desired to be secured by Letters Patent is as follows:

1. A toy dispersing reflective particles, comprising:

a support presenting a handle for hand-held use of the toy by a user, a shaft rotatably supported by said handle and extending therefrom for rotation with respect thereto, a hollow enclosure on said shaft and rotatable therewith for receiving reflective particles, said enclosure having an imperforate portion into which reflective particles are loaded and a perforate portion spaced from said shaft, said perforate portion having a plurality of spaced apertures therein with a diameter larger than reflective particles and a filler opening through which reflective particles are loaded, and a power means housed within said support and operatively connected to said shaft for rotating said shaft and said enclosure so that reflective particles loaded in said imperforate portion of said enclosure are caused to pass through said apertures under centrifugal force upon rotation of said shaft, whereby a burst of reflective particles is dispersed into the surrounding air, said imperforate portion having an end that tapers from said shaft to facilitate flow of reflective particles into said perforate portion.

2. A toy as claimed in claim 1, wherein said filler opening has a diameter larger than said diameter of said apertures.

3. A toy as claimed in claim 1, further comprising a closure insertable within said filler opening to prevent said reflective particles from escaping therethrough.

4. A toy as claimed in claim 1, wherein said enclosure is composed of rigid plastic.

5. A toy as claimed in claim 1, wherein said enclosure has a substantially oval configuration.

6. A toy as claimed in claim 1, wherein said enclosure extends angularly from said shaft to facilitate the dispersion of said reflective particles.

7. A toy as claimed in claim 1, wherein said enclosure extends axially from said shaft.

8. A toy as claimed in claim 1 further comprising:

a closure insertable within said filler opening to prevent reflective particles from escaping therethrough.

9. A toy dispersing reflective particles, comprising:

a support, a rotatable shaft rotatably supported by said support and rotatable with respect thereto, and a hollow enclosure attached at one end to said shaft, said enclosure having an open end for receiving reflective particles therein, said enclosure further having a plurality of spaced apertures therein, each said aperture having a flap extending thereover to prevent dispersion of reflective particles received within said enclosure, said flaps being attached to said enclosure and being flexibly resilient to uncover each aperture when reflective particles are caused to pass therethrough under centrifugal force upon rotation of said shaft, whereby a burst of reflective particles is dispersed into the surrounding air, said enclosure having an imperforate portion adjacent said shaft and a perforate portion spaced from said shaft, said perforate portion having said spaced apertures therein, said apertures with a diameter larger than reflective particles, said imperforate portion having an end that tapers from said shaft to facilitate flow of reflective particles into said perforate portion upon rotation of said shaft.

10. A toy as claimed in claim 9 wherein said enclosure extends angularly from said shaft to facilitate dispersion of reflective particles through said apertures.

11. A toy as claimed in claim 9 further comprising:

a power means housed within said support and operatively connected to said shaft for rotating said shaft and said enclosure so that reflective particles are caused to pass through said apertures under centrifugal force upon rotation of said shaft, whereby a burst of reflective particles is dispersed into the surrounding air.

* * * * *